United States Patent [19]

Scott

[11] 4,104,482

[45] Aug. 1, 1978

[54] SCREW-ON CONNECTOR

[75] Inventor: William J. Scott, Sycamore, Ill.

[73] Assignee: Ideal Industries, Inc., Sycamore, Ill.

[21] Appl. No.: 754,180

[22] Filed: Dec. 27, 1976

Related U.S. Application Data

[63] Continuation of Ser. No. 617,820, Sep. 29, 1975, abandoned.

[51] Int. Cl.[2] ..... H01R 5/12

[52] U.S. Cl. ..... 174/87; 29/628

[58] Field of Search ..... 174/87; 29/628

[56] References Cited

U.S. PATENT DOCUMENTS

| | | | |
|---|---|---|---|
| 1,678,752 | 7/1928 | Van Gelderen | 174/87 |
| 2,749,384 | 6/1956 | Scott | 174/87 |
| 3,308,229 | 3/1967 | Burniston | 174/87 |
| 3,519,707 | 7/1970 | Krup | 174/87 X |

FOREIGN PATENT DOCUMENTS

| | | | |
|---|---|---|---|
| 961,367 | 12/1973 | Italy. | |
| 376,138 | 7/1932 | United Kingdom | 174/87 |
| 546,920 | 8/1942 | United Kingdom | 174/87 |
| 678,994 | 9/1952 | United Kingdom | 174/87 |

OTHER PUBLICATIONS

Ideal Industries, Inc. advertisement, *Electrical Manufacturing*, Oct. 1953, p. 221.

*Primary Examiner*—Laramie E. Askin

*Attorney, Agent, or Firm*—Kinzer, Plyer, Dorn & McEachran

[57] ABSTRACT

This is concerned with a screw-on type insulating connector for joining the stripped ends of a plurality of electric wires or conductors and has a thread formation on what might otherwise be considered its conical surface, but this surface has a particular geometry in the nature of a concave frustum which enables it to hold particular combinations without bending and breaking the core pin.

26 Claims, 5 Drawing Figures fig.1.
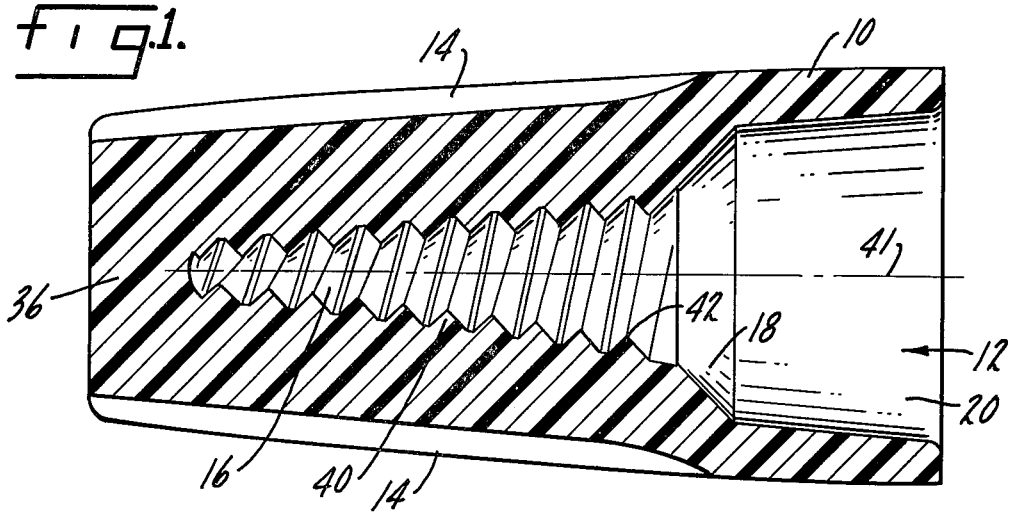
fig.2.
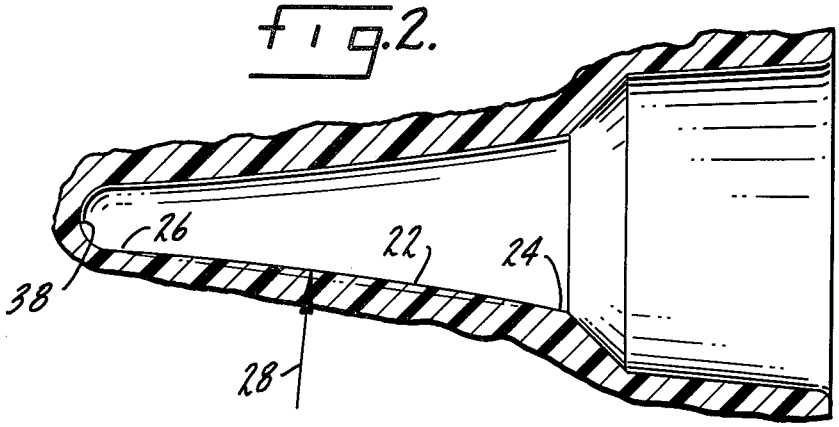
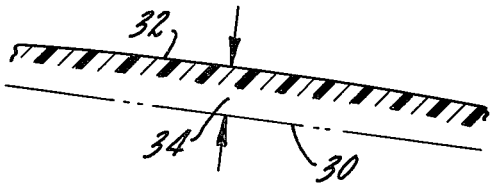
fig.3.

SCREW-ON CONNECTOR

This is a continuation, of application Ser. No. 617,820, filed Sept. 29, 1975 now abandoned.

Summary of the Invention

This is concerned with a screw-on or pigtail connector which is in the nature of an insulating cap that is threaded on its interior surface and is screwed down on the stripped ends of two or more electric wires, be they solid, stranded or otherwise.

A primary object of the invention is a connector that will hold small combinations of wires without easy unthreading.

Another object is a connector of the above type which has a particular shape or geometry of inner surface with variable included angles.

Another object is a connector of the above type which has a thread formation in the general shape of a concave frustum similar to the end of a horn.

Another object is a connector of the above type which may be thought of as having a continuously varying included angle from the minimum at its small end to the maximum at its large end.

Another object is a connector of the above type which may be made entirely out of plastic or may have a coiled wire insert which provides the thread form in its interior.

Other objects will appear from time to time in the ensuing specification and drawings.

BRIEF DESCRIPTION OF THE DRAWINGS

FIG. 1 is an axial section through the connector;

FIG. 2 is a diagrammatic of the interior of the connector of FIG. 1;

FIG. 3 is an enlargement of a part of FIG. 2;

DESCRIPTION OF THE PEFERRED EMBODIMENTS

Figure 4:
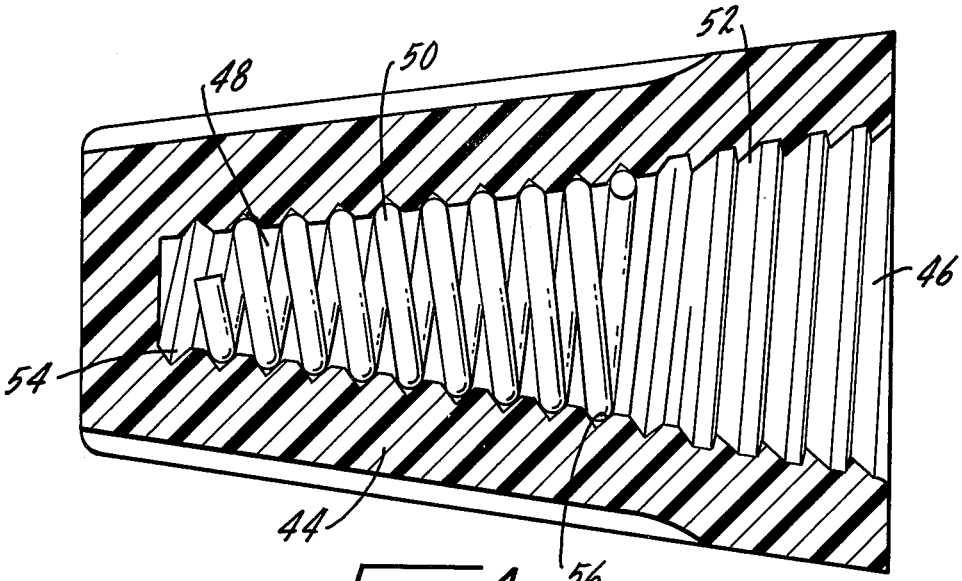
FIG. 4 is an axial section, with parts in full, of a variant form.

In FIG. 1 the connector 10 is shown generally in the shape of a frustum of a cone with an internally tapered bore 12. Throughout a substantial portion of the connector's outer surface, a plurality of grooves 14 may be provided which may be conventional. The bore 12 of the connector is divided generally into three portions, namely an inner portion 16, an intermediate portion 18, and an outer portion 20. The angle of divergence of the inner portion 16, which will be explained in detail hereinafter, is substantially less than the angle of divergence of the outer portion 20 and the outer portion is used primarily to get the wires of conductors properly to the interior of the connector and, if threads are formed thereon as explained hereinafter, secondarily to serve as an additional holding means. The intermediate portion 18 has the greatest angle of divergence. If the walls of the outer portion 20 are threaded, as explained in connection with FIGS. 4 and 5, which may be applied to the FIG. 1 form, even though they are shown there as smooth, the thread's primary function is to firmly engage the insulation surrounding the inserted conductors and to prevent the wires from easily being withdrawn from the bore of the connector.

The inner portion 16 is formed in a particular manner and the threads thereon have a certain geometry so that a tight, efficient joint connection is formed. The shape or geometry of the inner portion 16 is diagrammatically shown in FIG. 2 with the threads removed. This is to say that the surface of the inner portion 16 shown in FIG. 2 may be considered to be the root surface of the threads or the portion 16 with the threads removed down to their root. It will be noticed upon close inspection of FIG. 2 that the root surface, which is designated 22, might at first appear to be a frustum of a cone, but in reality the surface is swung inwardly somewhat between the small and large ends so that it has a greater included angle at the large end 24 than it does at the small end 26 with an ever changing included angle between them. This is to say that the surface 22 may be swung on a radius, indicated generally at 28, of a substantial dimension, compared to the size of the connector itself, such that the inner surface projects inwardly somewhat from a true cone, all the way around. This is diagrammatically indicated in FIG. 3 where a true cone or frustum thereof is indicated generally at 30 with the actual root surface being indicated at 32, FIG. 3 being considered an enlargement of the area generally at the midpoint, for example at the arrow 28, in FIG. 3. Thus this provides an inward offset by a distance generally represented at 34. The radius may be either a constant radius or a varying radius to produce an exponential curve, for example, an ellipse.

In FIG. 1 the connector is made entirely of plastic and representative values of the various angles may be as follows: The included angle at the small end 26 might be something on the order of 9° 30′, at the center 28 something on the order of 13° 15′, and at the outlet 24 something on the order of 17°. In such an arrangement the inward offset 34 might be something on the order of 0.003 inch in a size of connector where the surface of a straight side frustum would be 0.325 inch. The end of the bore at the end wall 36 of the shell is in the general shape of a hemisphere 38. The thread form 40 has sides which are at approximately 45° to the center line 41 and at approximately 90° to each other.

By way of elaboration, it is emphasized that the surface 22 is not a true frustum of a cone but rather goes inwardly somewhat in the nature of a horn which is to say that the surface is somewhat or slightly concave from a true cone. And since this shape does not have a well recognized geometric term, it shall be referred to as a concave frustum for lack of a better term.

The connector shown and described so far is specifically made of a plastic material. It should be noted that it does not have any type of crimpable ferrule, coil spring insert, or other wire-holding means. When the twisted bare wires, be they solid or stranded, are inserted into the bore of the connector, the plastic threads 40 on the inner surface of the bore are harder than the annealed or semi-annealed wires of the conductor. Thus, as the connector is twisted or turned over the wires or conductors, the wires are forced to the interior of the bore and the threads 40 form partial threads or grooves on the exposed surfaces of the conductors. The plastic threads 40 directly engage the wires and will not cut or abrade the surfaces of the wires. Rather, they will smoothly indent and slowly work-harden the surfaces of the wires. As the connector is smoothly twisted over the wires, the partial threads formed in the conductors become increasingly hardened until the wires work-harden sufficiently to prevent further thread formation. At this stage the twisted stripped ends of the wires will substantially cease their inward movement in the bore and will begin to rotate with the bore which serves to further coil the insulated portion of the conductors outside of the connector. This results in a very tightly wound connection between the wires, and the twisting action will cease when the operator can no longer rotate the connector. It has been found that an alpha-cellulose filled, melamine formaldehyde, thermosetting molding compound is very satisfactory for this connector. However, various other compounds have also proven successful. For example, it has been found that an alpha-cellulose filled, urea formaldehyde, thermosetting molding compound also will generally satisfy the various characteristics of the desired material. The general name for these types is amino which designates both urea and melamine. The general form of the threads 40 in the bore is also important due to the type of connection and holding action that is necessary in addition to the work-hardening which the threads perform on the surface of the wires. It should be realized that the crowns 42 of the threads are deliberately rounded somewhat so as to present a smooth work-hardening surface to the wires with the radius of the crowns being something on the order of 0.002 inch to 0.005 inch with the roots of the threads being relatively wide and deep.

A variant form of the invention has been shown in FIG. 4 in which the shell or cap 44 has a bore 46 with two parts or portions, the inner portion 48 which is threaded and has a coil spring insert 50 and an outer portion 52 which is also threaded but with a different thread formation and it does not have an insert. The FIG. 4 form may be considered to be a standard screw-on or pigtail type of connector long sold by the assignee hereof, Ideal Industries, Inc. of Sycamore, Ill., under the trademark "WIRE-NUT" excpet that the inner portion 48, instead of being a true frustum of a cone, is in the shape of a concave frustum or horn with the included angle at the base or small end 54 of the bore being less than the included angle at the large end 56 of the inner portion. The coil spring or insert 50 is also in the shape of a concave frustum and it may be wound in that shape before it is inserted or, if desired, it may be a true conical frustum prior to insertion and, after it is screwed into the cap, it will assume the concave frustum or horn shape of the inner threaded surface 48.

Figure 5:
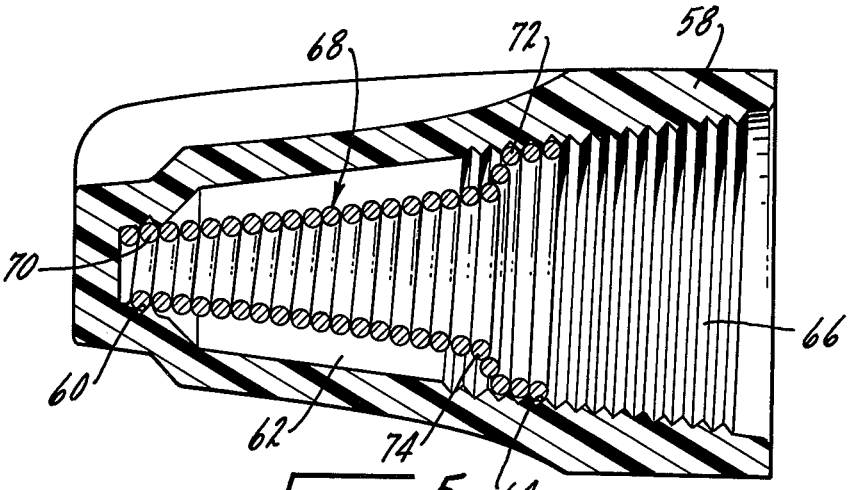
FIG. 5 is an axial section of a variant form.

In FIG. 5 a further variation has been shown in which the shell or cap 58 may be considered to have a number of sections, a small end 60 which may be threaded, an enlarged portion 62 thereafter which may be smooth, a further enlarged section 64 which may be threaded, and an entrance portion 66 which may also be threaded. The connector has a coil insert 68 which, at its small end 70, engages the small threaded portion 60 of the bore and may be expanded somewhat at its large end, as at 72, so that it meshes or fits against or with the portion 64 of the bore, the coil being generally out of contact with the cap in the area 62 between its large and small ends. It should be understood that the coil or spring 68 is in the form of a concave frustum or horn, which is to say that at its small end, generally in the area 70, the included angle is less than at the large end, for example generally in the area 74, with a progression in between. The coil insert may have the turns of the coil all or substantially all brazed together throughout its length along the lines of what is shown and described in Ser. No. 602,440, filed Aug. 6, 1975, and assigned to this assignee. But, again, the distortable retainer, whether it is in the form of a brazed coil or otherwise, would have a varying included angle between its small and large ends so that it would be in the general shape of a concave frustum.

The use, operation and function of the invention are as follows:

In prior connectors the threaded bore of the cap was disposed at a particular included angle whether it was an all plastic connector, a free spring connector, or a distortable retainer connector. It was desired that the included angle of the cone be at a relatively small value in order to hold successfully the small combinations of wires without easy unthreading. A typical example in an all plastic connector might be something on the order of 9° 30′. But this resulted in an undesirable mortality rate of the core pins from bending and breaking at the minor thread diameter near the base of the cone which proved undesirably expensive.

One approach to solving this problem was to take the included angle to a higher value, for example 13° 30′ which increased the root diameter of the thread at the base of the cone and widened the range of possible combinations that it would hold. At the same time the thread depth was increased to gain some additional metal on the core pin on which the connector was molded and further reduced the plastic section. At the end of the cone, the flat end could be changed to a hemisphere to reduce the tendency of the sharp thread end to rip off.

But going to a 13° 30′ included angle involved a sacrifice in that some of the small combinations would be inadequately held due to unthreading, particularly when solid wires or dip-soldered ends were used. This was particularly true with all plastic connectors in the small sizes where customers needed a quite small connector to fit into small spaces that other connectors were unable to fit.

The present connector is a solution to the problem in that the small included angle, i.e. something on the order of 9° 30′, is retained at the small end of the cone or bore but thereafter the bore is belled out so that at its large end it may be something on the order of 17° included angle. This will or may give approximately 13° 15′ at the center of the threaded section. This gives a larger set of diameters to the base of the frustum for strength and the thread form has sides which are at 45° to the center line to get a better grip on the conductor and permit more economical thread grinding. While the precise geometric shape has been referred to herein as a concave frustum or a horn, it should be undestood that the precise geometric shape is not known to have a well recognized designation, and it should be understood that the horn shape or concave frustum may be considered to be a series of ever increasing included angles starting from the smallest at the small end and working out to the largest at the large end, either swung on a constant radius or a series of varying radii, like an ellipse or any suitable exponential curve.

While a preferred form and several variations of the invention have been shown and described, it should be understood that suitable additional modifications, changes, substitutions and alterations may be made without departing from the invention's fundamental theme.

The embodiments of the invention in which an exclusive property or privilege is claimed are defined as follows:

1. An insulated cap for covering and connecting by compression the stripped ends of a plurality of insulated electrical conductor wires or the like, comprising a shell of insulating material with an interior open at one end to receive the stripped ends of the wires and closed at the other end by an end wall, and a wire-engaging, nonexpanding thread formation in the interior for engaging the stripped ends of the wires, the thread formation being larger at one end than at the other with the large end being disposed toward the open end of the shell and the small end toward the end wall of the shell, the thread formation being in the general shape of a concave frustum of a cone so that the small end is at a lesser included angle than the included angle at the large end while presenting an intermediate included angle different from the other two included angles.

2. The structure of claim 1 further characterized in that the thread formation is integral with the shell and is made entirely of plastic.

3. The structure of claim 1 further characterized in that the thread form is in the form of a separate coil wire which is inserted in the shell.

4. The structure of claim 3 further characterized in that the adjacent turns of the coil wire are connected to each other by a braze material and the center portion of the coil wire is out of contact with the open interior of the shell.

5. The structure of claim 3 further characterized in that the coil wire is in contact with the interior of the shell substantially throughout the length of the coil wire.

6. The structure of claim 5 further characterized in that the adjacent turns of the coil wire are out of contact with each other substantially throughout the length of the coil wire.

7. The structure of claim 1 further characterized in that the included angle at the small end of the concave frustum is on the order of 9° 30′.

8. The structure of claim 1 further characterized in that the included angle generally at the center of the concave frustum is on the order of 13° 15′.

9. The structure of claim 1 further characterized in that the included angle at the large end of the concave frustum is on the order of 17°.

10. The structure of claim 1 in which the included angle at the small end of the concave frustum is on the order of 9° 13′, at the middle of the concave frustum is on the order of 13° 15′, and at the large end of the concave frustum is on the order of 17°.

11. The structure of claim 1 further characterized in that the inner surface of the end wall in the interior of the shell is in the general formation of a hemisphere.

12. The structure of claim 1 further characterized in that the shell and thread formation are integral and made entirely of plastic and the threads formed thereon have their sides at approximately 45° to the center line of the shell.

13. The structure of claim 1 further characterized in that the sides of the concave frustum are offset inwardly at their midpoint by a distance on the order of 0.003 inch from a straight-sided frustum.

14. An insulated cap for covering and connecting by compression the stripped ends of a plurality of insulated electrical conductor wires or the like, including a shell of insulating material with an interior open at one end to receive the stripped ends of the wires and closed at the other end by an end wall, and a wire-engaging, nonexpanding thread formation in the interior for engaging the stripped ends of the wires, the thread formation being larger at the open end of the shell and smaller toward the end wall, the small end of the thread formation being at a lesser included angle than the included angle at the large end while presenting an intermediate included angle different from the other two included angles.

15. The structure of claim 14 further characterized in that the thread formation is integral with the shell and is made entirely of plastic.

16. The structure of claim 14 further characterized in that the thread form is a separate coil wire which is inserted in the shell.

17. The structure of claim 16 further characterized in that the adjacent turns of the coil wire are connected to each other by a braze material and the center portion of the coil wire is out of contact with the open interior of the shell.

18. The structure of claim 16 further characterized in that the coil wire is in contact with the interior of the shell substantially throughout the length of the coil wire.

19. The structure of claim 14 further characterized in that the interior of the shell is in the form of a concave frustum of a cone.

20. The structure of claim 14 further characterized in that the interior of the shell is formed as a series of frustoconical sections increasing in included angle from the small end to the large end.

21. An all plastic insulating cap for covering and connecting by compression the stripped ends of a plurality of insulated electric conductor wires, the cap being in the form of a shell composed entirely of insulating plastic with an interior open at one end to receive the stripped ends of the wires and closed at the other end by an integral end wall, the open interior of the shell in its final state of manufacture being formed and arranged as an unencumbered wire-receiving bore converging inwardly in the general form of a concave frustum of a cone and defined by a wire-engaging nonexpanding rigid plastic thread-forming surface for engaging the stripped ends of the wires, the wire-engaging thread-forming surface being larger at the open end of the shell and smaller toward the end wall, the small end of the wire-engaging thread-forming surface being at a lesser included angle than the included angle at the large end.

22. The structure of claim 21 further characterized in that the thread-forming surface has an intermediate included angle different from the other two included angles.

23. The structure of claim 21 further characterized in that the small end of the wire-engaging thread-forming surface is at an included angle on the order of 9° 13′, and the large end of the wire-engaging thread-forming surfaces is at an included angle on the order of 17°.

24. An all plastic insulating cap covering and connecting by compression the stripped ends of a plurality of insulated electric conductor wires, the cap being in the form of a shell composed entirely of insulating plastic with an interior open at one end to receive the stripped ends of the wires and closed at the other end by an integral end wall, the open interior of the shell in its final state of manufacture being formed and arranged as an unencumbered wire-receiving bore converging inwardly in the general form of a concave frustum of a cone and defined by a wire-engaging nonexpanding rigid plastic thread-forming surface engaging the stripped ends of the wires, the wire-engaging thread-forming surface being larger at the open end of the shell and smaller toward the end wall, the small end of the wire-engaging thread-forming surface being at a lesser included angle than the included angle at the large end, the threads of the wire-engaging thread-forming surface at both the smaller and larger portion of the bore having a uniform pitch throughout, gripping the stripped ends of the wires, and having rounded crowns throughout with the exposed surfaces of the stripped ends of the wires uniformly grooved and threaded thereby.

25. The structure of claim 24 further characterized in that the thread-forming surface has an intermediate included angle different from the other two included angles and by which the stripped ends of the wires are gripped.

26. A method of joining the stripped ends of a plurality of insulated electric wires, including the steps of providing an insulating cap having a generally open threaded central bore in the general shape of a concave frustum of a cone with at least two threaded thread-forming portions therein that have different included angles, grouping together the stripped ends of a plurality of insulated electric wires, inserting the thus grouped stripped ends into the threaded bore of the cap, initially engaging the stripped ends of the wires with threaded thread-forming portion having a greater included angle while turning the cap down progressively on the stripeed ends of the wires, and thereafter engaging the stripped ends of the wires with a threaded thread-forming portion having a lesser included angle than the initially engaged portion while continuing to turn the cap down progressively on the stripped ends of the wires so the stripped ends of the wires are captured in both included angles.

* * * * *